US010247496B2

(12) United States Patent
Kincel

(10) Patent No.: US 10,247,496 B2
(45) Date of Patent: Apr. 2, 2019

(54) CHARGING HANDLE WITH IMPROVED GAS DEFLECTION

(71) Applicant: Abrams Airborne Manufacturing Inc., Tucson, AZ (US)

(72) Inventor: Eric Stephen Kincel, Las Vegas, NV (US)

(73) Assignee: ABRAMS AIRBORNE MANUFACTURING INC., Tucson, AZ (US)

( * ) Notice: Subject to any disclaimer, the term of this patent is extended or adjusted under 35 U.S.C. 154(b) by 0 days.

(21) Appl. No.: 15/585,867

(22) Filed: May 3, 2017

(65) Prior Publication Data

US 2017/0336158 A1 Nov. 23, 2017

Related U.S. Application Data

(63) Continuation of application No. 13/317,196, filed on Oct. 12, 2011, now Pat. No. 9,677,833.

(51) Int. Cl.
*F41A 3/72* (2006.01)

(52) U.S. Cl.
CPC ..... *F41A 3/72* (2013.01)

(58) Field of Classification Search
CPC ..... F41A 3/12; F41A 3/72; F41A 7/00; F41A 7/02; F41A 7/04; F41A 7/06; F41A 19/34
USPC ..... 89/1.4, 1.42
See application file for complete search history.

(56) References Cited

U.S. PATENT DOCUMENTS 1,517,351 A 12/1924 Fletcher
3,225,653 A 12/1965 Packard
5,351,598 A 10/1994 Schuetz
5,448,940 A 9/1995 Schuetz
5,499,569 A 3/1996 Schuetz
5,551,179 A 9/1996 Young
6,311,603 B1 11/2001 Dunlap
7,231,861 B1 6/2007 Gauny
7,240,600 B1 7/2007 Bordson
7,461,581 B2 12/2008 Leitner-Wise
7,707,921 B1 5/2010 Hoel
7,798,045 B1 9/2010 Fitzpatrick
7,900,546 B2 3/2011 Bordson
8,209,896 B1 7/2012 Cashwell
9,677,833 B2 * 6/2017 Kincel ..... F41A 3/72
2011/0214558 A1 9/2011 Kincel
2011/0226120 A1 9/2011 Fitzpatrick

OTHER PUBLICATIONS

Unknown Author, Do It Yourself Gas Busting Charging Handle [Sep. 20, 2009], "(Originally written in 2003 / 2004—updated Sep. 29, 2009)," Internet Publication, 5 of 5 pages, at: http://www.03designgroup.com/technotes/do-it-yourself-gas-buster-charging-handle.*

Wayback Machine archival of the above document, Jul. 12, 2010, at: https://web.archive.org/web/20100712072300/http://www.03designgroup.corn/technotes/do-it-yourself-gas-buster-charging-handle.*

* cited by examiner

*Primary Examiner* — Bret Hayes
(74) *Attorney, Agent, or Firm* — Fay Sharpe LLP

(57) ABSTRACT

A charging handle for a firearm which has a handle portion connected to a pull rod member. A bore hole collects exhaust gases passing over the top of the rod member and directs the gases to vent tunnel(s) which extend perpendicular to the rod member. In the preferred embodiment, a deflecting surface is used to further direct the exhaust gases to the bore hole. Further embodiments provide seals to protect the user from any exhaust gas which has not been vented.

20 Claims, 6 Drawing Sheets

CHARGING HANDLE WITH IMPROVED GAS DEFLECTION

This application is a continuation of U.S. application Ser. No. 13/317,196, filed on Oct. 12, 2011, now U.S. Pat. No. 9,677,833, the subject matter of which is hereby incorporated herein by reference in its entirety.

BACKGROUND OF THE INVENTION

The invention relates generally to charging handles for firearms and more particularly to charging handles having mechanisms to minimize gas discharge affecting the user of the firearm.

For many modern firearms, a charging handle is used to engage the bolt assembly of the firearm so that a preliminary cartridge is loaded into the chamber. This charging handle is typically mounted parallel with the bolt assembly and is manually operated to pull the bolt assembly to insert the first cartridge. Once the first cartridge is loaded, the charging handle is latched to the firearm as the firing of the first cartridge produces sufficient gas pressure to load the second and subsequent cartridges.

Although the gas pressure is utilized to re-charge or reload the cartridges into the chamber, a portion of the gas is inadvertently discharged along the top of the charging handle to impact upon the shooter's face and eyes. This is uncomfortable and is additionally dangerous as unspent gun powder and embers can also be carried along with the gases into the face of the shooter.

A few charging handles have attempted to solve this problem by erecting "barriers" to divert the gas away from the face or with channels which are used to assist in re-directing the gas discharge. Unfortunately, these techniques, although reducing the amount of discharge gases impacting the user, do not reduce the amount of discharge gas to any large extent; hence, there is still an unsatisfactory level of gases being directed to the shooter's face.

It is clear from the foregoing that there is a need for improved gas deflection mechanisms for charging handles.

SUMMARY OF THE INVENTION

The invention relates to a charging handle assembly for a firearm. Those of ordinary skill in the art readily recognize the use of a charging handle. Examples of such apparatus are described in: U.S. Pat. No. 5,351,598, entitled "Gas-Operated Rifle System" issued to Schuetz on Oct. 4, 1994; U.S. Pat. No. 5,448,940, entitled "Gas-Operated M16 Pistol" issued to Schuetz et al. on Sep. 12, 1995; U.S. Pat. No. 5,551,179, entitled "Bolt Carrier" issued to Young on Sep. 3, 1996; U.S. Pat. No. 5,499,569, entitled "Gas-Operated Rifle System" issued to Schuetz on Mar. 19, 1996; and, U.S. Pat. No. 7,461,581, entitled "Self-Cleaning Gas Operating System for a Firearm" issued to Leitner-Wise on Dec. 9, 2008, all of which are incorporated hereinto by reference.

This invention relates to a charging handle for a firearm which has a handle portion connected to a pull rod member. A bore hole collects exhaust gases passing over the top of the rod member and directs the gases to vent tunnel(s) which extend perpendicular to the rod member. In the preferred embodiment, a deflecting surface is used to further direct the exhaust gases to the bore hole. Further embodiments provide seals to protect the user from any exhaust gas which has not been vented.

The invention produces a charging handle for a firearm. The charging handle consists of a handle portion connected to a pull rod member where a catch mechanism is positioned at the proximal end of the charging handle to engage the action of the firearm.

During discharge of the firearm, a certain amount of exhaust passes over the top of the pull rod. This exhaust gas is directed to a bore hole which communicates to at least one vent tunnel located within the handle. The vent tunnel directs the exhaust gas from the bore hole perpendicular to the rod member, and away from the user's face.

The charging handle in the preferred embodiment includes a deflecting surface positioned to direct gases flowing down a top of said rod member to said bore hole.

The preferred deflecting surface is employed to further protect the user and also to encourage the exhaust gas into the bore hole. The ideal deflecting surface is sloped downward towards the top of the handle and forms a semi-circle around said bore hole.

In another embodiment, a pliable seal is used to seal the top of the pull rod to the to the action mechanism. This seal also directs the exhaust gas to the bore hole so that the gases are not passed through to the user's face.

This preferred seal arrangement uses a recess positioned in a top surface of the handle portion with a pliable seal secured within the recess. This pliable seal extends above the top surface of said handle portion to contact the action mechanism when the charging handle is at rest.

Another seal of the present invention is optionally places between the deflecting handle and the action mechanism to form a tighter seal and further encourage the exhaust gases from impacting the user.

While the preferred embodiment uses a semi-circular deflecting surface, another embodiment uses two "wall" sections positioned on the handle itself to direct any escaping exhaust gas away from the user.

In some embodiments, the vent tunnel extends across the entirety of said handle portion to exhaust gases in both lateral directions, not into the face of the user.

The vent tunnels in one embodiment communicate with a spring recess in said handle portion. This spring recess is used with the locking mechanism for the charging handle and encourages the locking mechanism to stay in a locked position.

The invention, together with various embodiments thereof will be more fully explained by the accompanying drawings and the following descriptions thereof.

DRAWINGS IN BRIEF

FIGS. 1A, 1B, and 1C illustrate the preferred embodiment of the invention.

DRAWINGS IN DETAIL

Figure 1A:
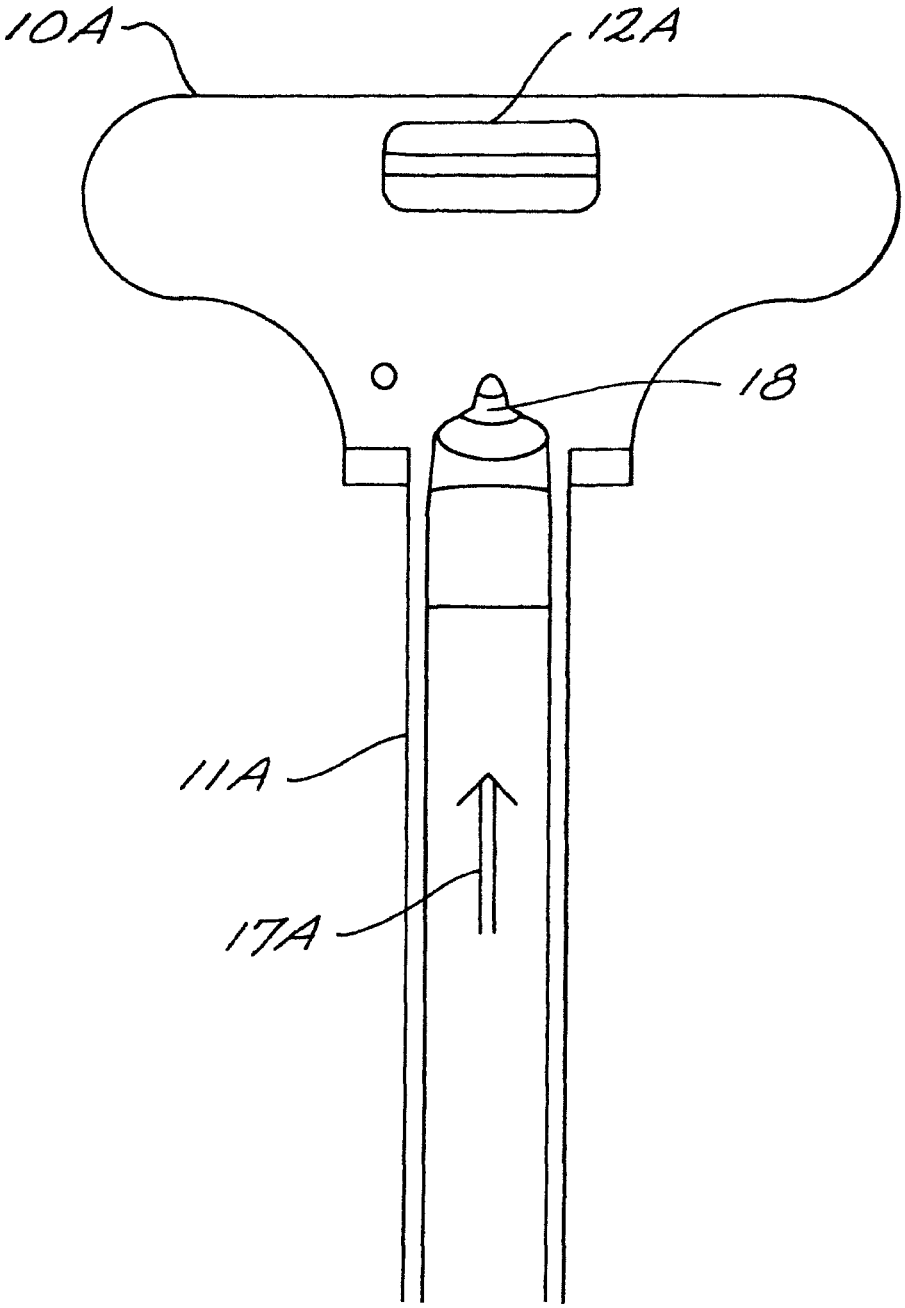
Figure 1B:
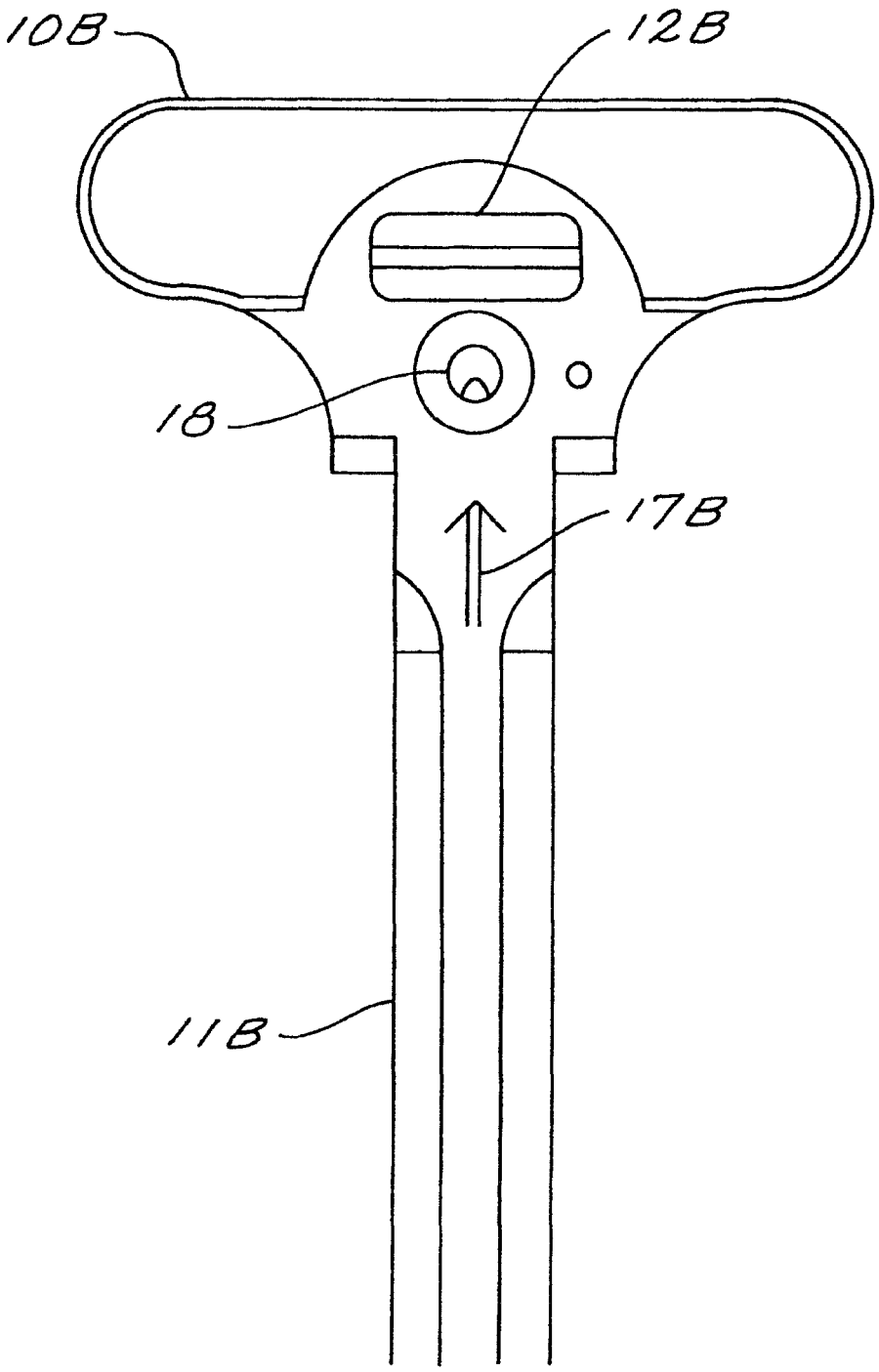
Figure 1C:
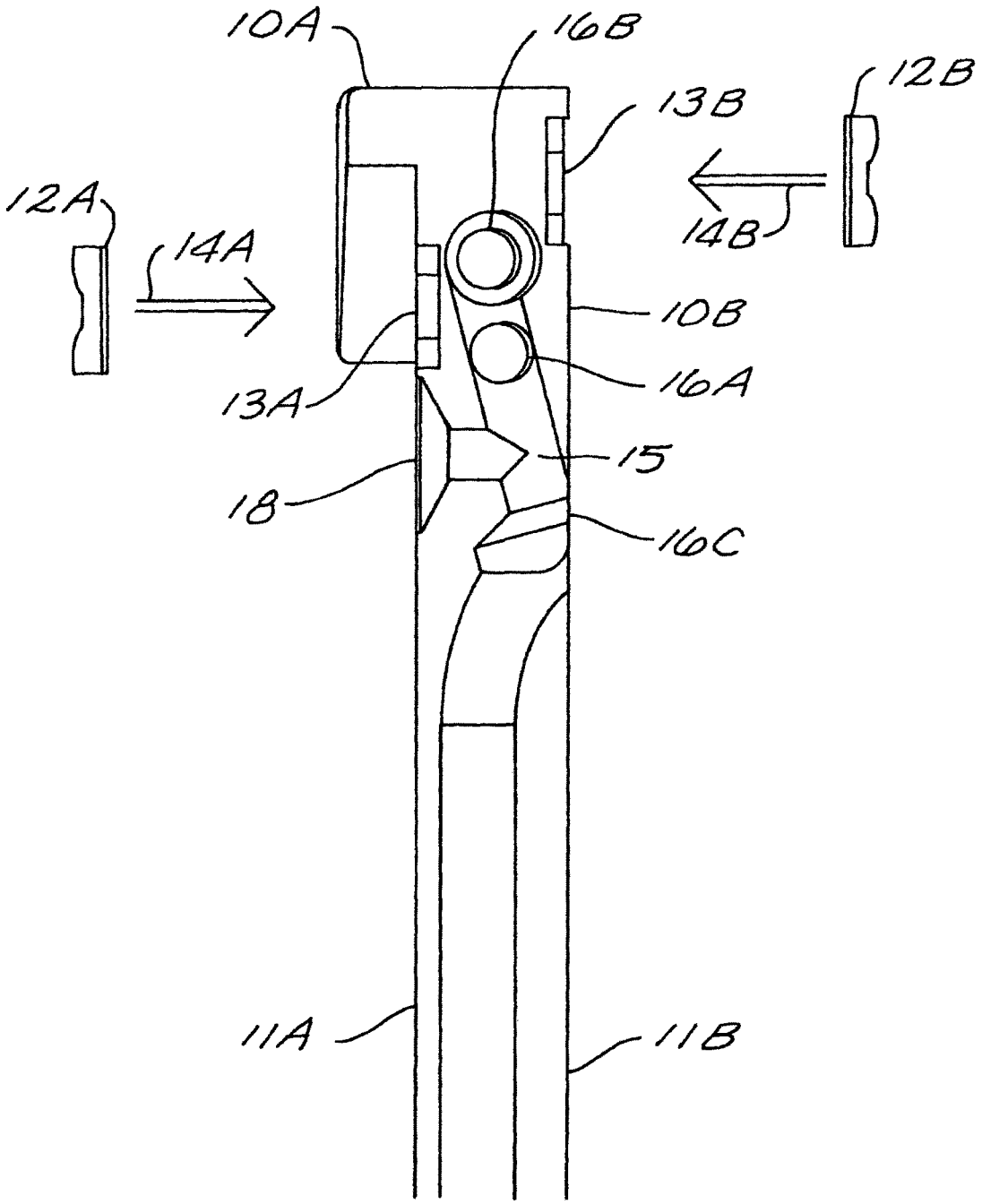

FIGS. 1A, 1B, and 1C illustrate the preferred embodiment of the invention. FIG. 1A is a bottom view of the preferred charging handle; FIG. 1B is a top view of the preferred charging handle, and FIG. 1C illustrates the application of the seals to the charging handle.

The charging handle consists of a handle portion 10A/10B connected to a pull rod member 11A/11B. During discharge of the firearm, a certain amount of exhaust passes across the bottom of the pull rod 11A as illustrated by arrow 17A. This exhaust gas 17A is directed to a bore hole 18 which communicates with vent 15 and then to exhaust vents 16A, 16B, and 16C. Exhaust vents 16A and 16B direct the exhaust gas perpendicular to pull rod 11A/11B, avoiding the users face. Exhaust vent 16C discharges the exhaust gas downward and away from the users face.

In this fashion, exhaust gases 17B are directed to vent 18 which communicates the exhaust gases 17B safely away from the user.

This charging handle also includes seals 12A and 12B which are secured into recesses 13A and 13B respectively as illustrated by arrows 14A and 14B. Seals 12A and 12B engage the action mechanism body to further protect the users face.

The exhaust vent tunnels in one embodiment communicate with a spring recess 16B (spring is not shown for clarity) in said handle portion. This spring recess 16B contains the spring used with the locking mechanism for the charging handle (not shown for simplicity purposes).

In another embodiment of the invention, the vent tunnels extend across the entirety of the handle portion 10A/10B.

Figure 2A:
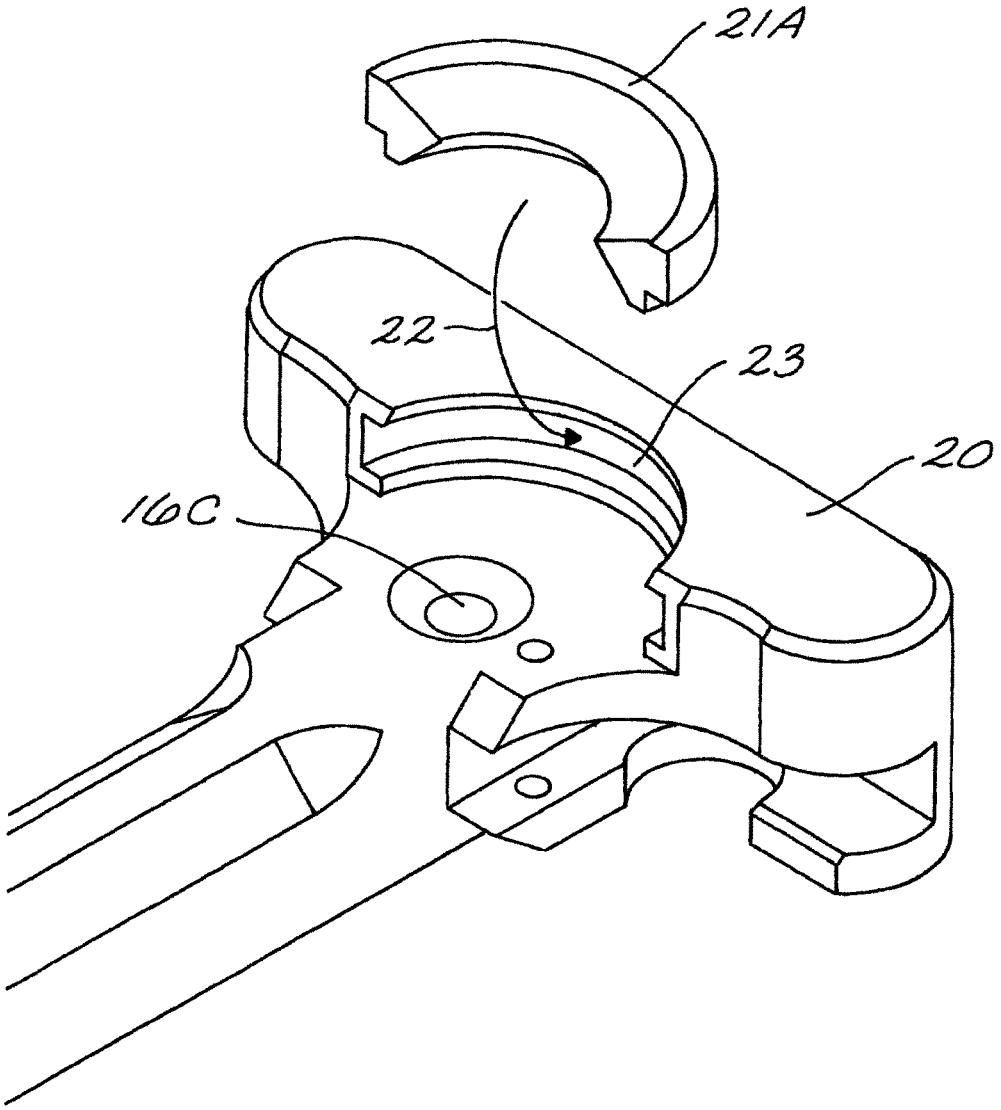
FIGS. 2A and 2B illustrate an alternative embodiment's sealing mechanism.
Figure 2B:
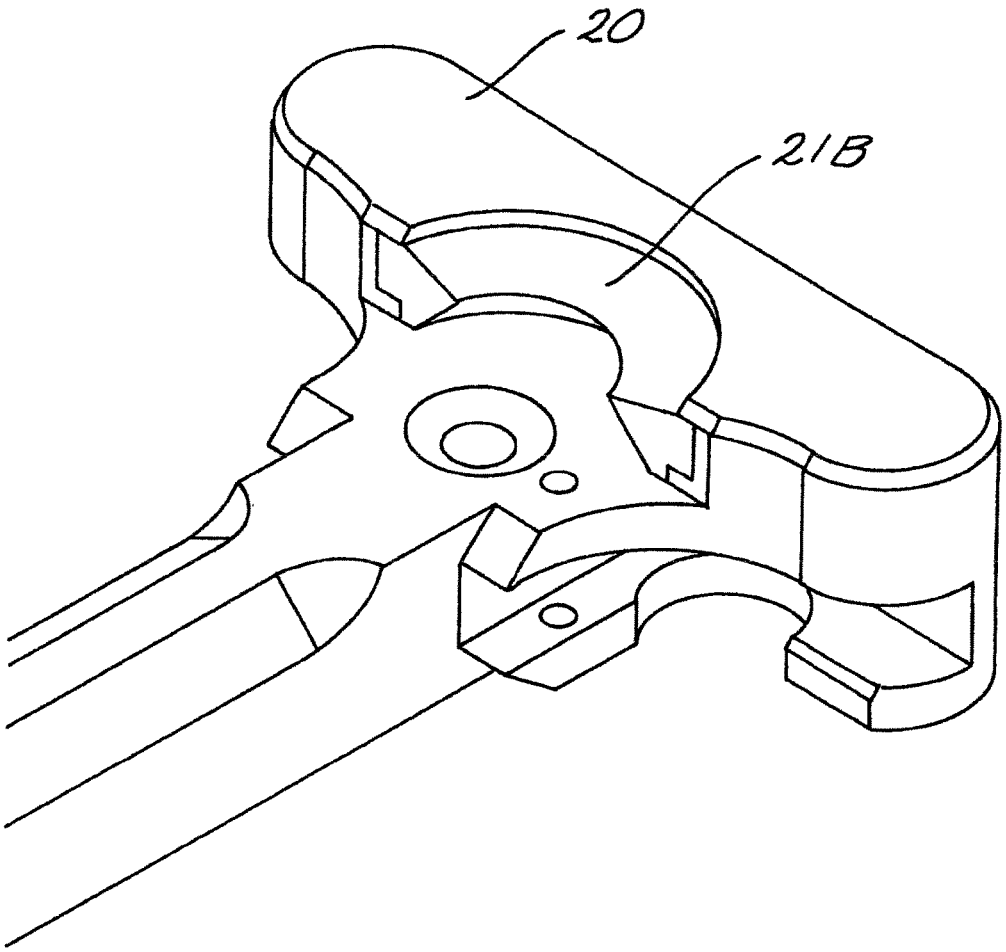

FIGS. 2A and 2B illustrate an alternative embodiment's sealing mechanism.

On the handle portion 20, a deflecting surface 23 is also employed to further protect the user and also to encourage the exhaust gas into the bore hole 16C. In one embodiment, the deflecting surface 23 is sloped downward towards the top of the handle and forms a semi-circle around the vent 18.

For further affect, a pliable seal 21A is secured to the deflecting surface 23 as illustrated by arrow 22, as shown by seal 21B. Seal 21B also directs the exhaust gas to the bore hole 12 so that the gases are not passed through to the user's face.

While the preferred embodiment uses a semi-circular deflecting surface, another embodiment uses two "wall" sections positioned on the handle itself to direct any escaping exhaust gas away from the user.

Figure 3:
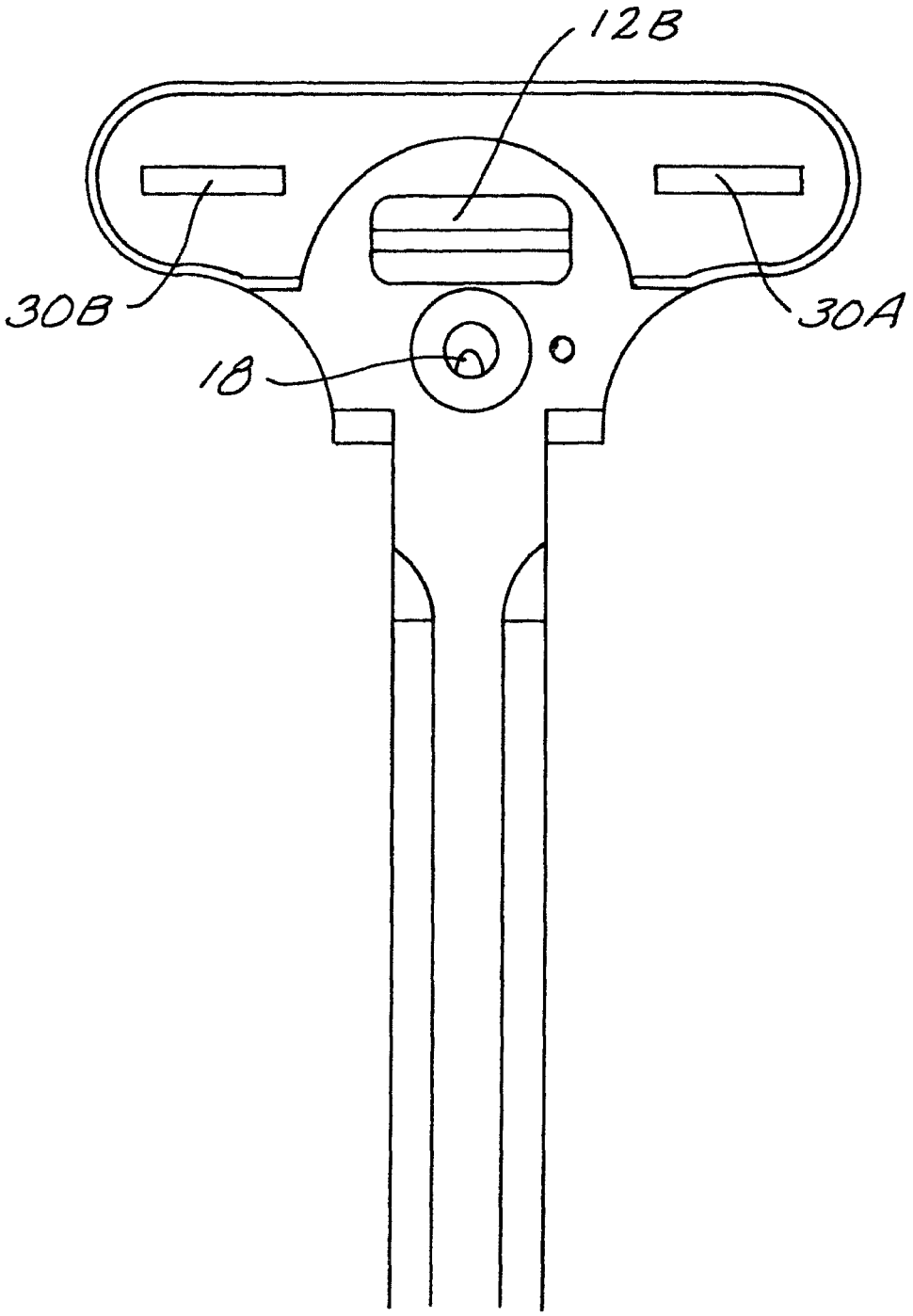
FIG. 3 illustrates the placement of the deflecting walls in one embodiment of the invention.

FIG. 3 illustrates the placement of the deflecting walls in one embodiment of the invention.

Deflecting walls 30A and 30B are raised portions which assist in deflecting any exhaust gases that are not blocked by seals 12B or exhausted via vent 18.

It is clear that the present invention provides a highly improved charging handle which provides for efficient gas discharge diversion away from the users face.

What is claimed is:

1. A charging handle for an associated firearm that has an associated action mechanism and that is operative to generate associated discharge gases, said charging handle comprising:

a pull rod member extending in a lengthwise direction between a proximal end and a distal end;

a handle portion disposed along said proximal end of said pull rod member, said handle portion having a first side and a second side facing opposite said first side, said handle portion including:

a first curvilinear surface portion along said first side of said handle portion;

a second curvilinear surface portion along said first side of said handle portion, said second curvilinear portion disposed in spaced relation to said first curvilinear portion in a direction opposite said second side; and, a third curvilinear surface portion along said first side of said handle portion, said third curvilinear surface portion disposed between said first and second curvilinear surface portions and extending into said handle portion in a direction outward of said first and second curvilinear surface portions at least partially forming a curvilinear recess; and, a curvilinear pliable seal disposed along said handle portion adjacent said proximal end of said pull rod member with a first portion of said curvilinear pliable seal disposed within said curvilinear recess, said curvilinear pliable seal dimensioned to operatively engage the associated action mechanism and thereby at least partially deflect associated discharge gases flowing in said lengthwise direction toward said handle portion.

2. A charging handle according to claim 1, wherein said curvilinear pliable seal includes a second portion extends radially inward beyond at least one of said first and second curvilinear surface portions.

3. A charging handle according to claim 1, wherein said curvilinear pliable seal includes an inner edge having a concave shape facing toward said distal end of said pull rod.

4. A charging handle according to claim 1, wherein said handle portion includes an approximately planar base surface disposed along said first side, and said curvilinear pliable seal includes a bottom surface disposed in facing relation to said approximately planar base surface of said handle portion.

5. A charging handle according to claim 1, wherein said curvilinear pliable seal includes a deflecting surface disposed in facing relation to said distal end of said pull rod member and operative to at least partially deflect associated discharge gases flowing in said lengthwise direction toward said handle portion.

6. A charging handle according to claim 1, wherein said handle portion includes a side wall oriented transverse to said lengthwise direction, and said side wall includes one or more of said first and second curvilinear surface portions.

7. A charging handle according to claim 6, wherein said side wall of said handle portion has a curvilinear shape, and said curvilinear pliable seal projects radially inward beyond said side wall.

8. A charging handle according to claim 1, wherein one of said first and second curvilinear surface portions has a semi-cylindrical shape.

9. A charging handle according to claim 1, wherein said curvilinear pliable seal redirects associated discharge gases moving in said lengthwise direction towards a radial center of said curvilinear pliable seal.

10. A charging handle according to claim 1, wherein one of said first and second curvilinear surface portions has a semi-frustoconical shape.

11. A charging handle according to claim 1, wherein said handle portion includes a first shoulder surface portion facing away from said second side and a second shoulder surface portion facing toward said first shoulder surface portion, said first shoulder surface portion extending between and interconnecting said first and third curvilinear surface portions, said second shoulder surface portion extending between and interconnecting said second and third curvilinear surface portions.

12. A charging handle for an associated firearm that has an associated action mechanism and that is operative to generate associated discharge gases, said charging handle comprising:

a pull rod member extending in a lengthwise direction between a proximal end and a distal end;

a handle portion disposed along said proximal end of said pull rod member, said handle portion extending between opposing handle ends disposed outwardly from said proximal end in a widthwise direction that is oriented transverse to said lengthwise direction, and said handle portion including a top surface portion and a bottom surface portion facing opposite one another in a heightwise direction that is oriented transverse to said lengthwise and widthwise directions, said handle portion including:

a first curvilinear surface portion along said first side of said handle portion;

a second curvilinear surface portion along said first side of said handle portion, said second curvilinear portion disposed in spaced relation to said first curvilinear portion in a direction opposite said second side; and, a third curvilinear surface portion along said first side of said handle portion, said third curvilinear surface portion disposed between said first and second curvilinear surface portions and extending outwardly into said handle portion beyond said first and second curvilinear surface portions to at least partially form a curvilinear recess within said handle portion; and, a curvilinear pliable seal disposed along said top surface portion of said handle portion adjacent said proximal end of said pull rod member, said curvilinear pliable seal including a first portion disposed within said curvilinear recess and an inner edge having a concave shape opening toward said distal end of said pull rod member with said inner edge dimensioned to operatively engage the associated action mechanism and thereby at least partially deflect associated discharge gases flowing in said lengthwise direction toward said handle portion.

13. A charging handle according to claim 12, wherein said inner edge of said pliable seal is offset from said top surface portion of said handle portion along said first side of said charging handle.

14. A charging handle according to claim 13, wherein said inner edge of said pliable seal is oriented in approximate alignment with said top surface portion of said handle portion.

15. A charging handle according to claim 12, wherein said curvilinear pliable seal includes an approximately planar bottom surface portion disposed in abutting engagement with said top surface portion of said handle portion, and said curvilinear pliable seal includes an approximately planar top surface portion facing away from said top surface portion of said handle portion.

16. A charging handle according to claim 12, wherein said first portion of said pliable seal includes a convex outer surface portion facing away from said distal end of said pull rod member and toward said third curvilinear surface portion of said handle portion.

17. A charging handle according to claim 12, wherein said handle portion includes a side wall oriented transverse to said lengthwise direction and having a concave shape, said side wall including at least one of said first and second curvilinear surface portions.

18. A charging handle according to claim 12, wherein said handle portion includes a first shoulder surface portion facing away from said second side and a second shoulder surface portion facing toward said first shoulder surface portion, said first shoulder surface portion extending between and interconnecting said first and third curvilinear surface portions, said second shoulder surface portion extending between and interconnecting said second and third curvilinear surface portions.

19. A charging handle for an associated firearm that has an associated action mechanism and that is operative to generate associated discharge gases, said charging handle comprising:

a pull rod member extending in a lengthwise direction between a proximal end and a distal end;

a handle portion disposed along said proximal end of said pull rod member, said handle portion having a first side and a second side facing opposite said first side, said handle portion including:

a first curvilinear surface portion along said first side of said handle portion;

a second curvilinear surface portion along said first side of said handle portion, said second curvilinear portion disposed in spaced relation to said first curvilinear portion in a direction opposite said second side;

a third curvilinear surface portion along said first side of said handle portion, said third curvilinear surface portion disposed between said first and second curvilinear surface portions and extending into said handle portion in a direction outward of said first and second curvilinear surface portions at least partially forming a curvilinear recess;

a first shoulder surface portion facing away from said second side, said first shoulder surface portion extending between and interconnecting said first and third curvilinear surface portions; and, a second shoulder surface portion facing toward said first shoulder surface portion, said second shoulder surface portion extending between and interconnecting said second and third curvilinear surface portions such that said curvilinear recess is at least partially formed by said third curvilinear surface portion between said first and second shoulder surface portions; and, a curvilinear pliable seal disposed along said handle portion adjacent said proximal end of said pull rod member with a first portion of said curvilinear pliable seal disposed within said curvilinear recess, said curvilinear pliable seal dimensioned to operatively engage the associated action mechanism and thereby at least partially deflect associated discharge gases flowing in said lengthwise direction toward said handle portion.

20. A charging handle according to claim 19, wherein one of said first and second curvilinear surface portions has a semi-cylindrical shape and the other of said first and second curvilinear surface portions has a semi-frustoconical shape.

* * * * *